United States Patent [19]

Hahn

[11] Patent Number: 5,048,191

[45] Date of Patent: Sep. 17, 1991

[54] RAZOR BLADE TECHNOLOGY

[75] Inventor: Steve S. Hahn, Wellesley Hills, Mass.

[73] Assignee: The Gillette Company, Boston, Mass.

[21] Appl. No.: 599,267

[22] Filed: Oct. 16, 1990

Related U.S. Application Data

[63] Continuation of Ser. No. 535,741, Jun. 8, 1990, abandoned.

[51] Int. Cl.[5] ..... B26B 21/54

[52] U.S. Cl. ..... 30/346.54; 76/104.1; 76/DIG. 8

[56] References Cited

U.S. PATENT DOCUMENTS

| | | |
|---|---|---|
| 2,555,214 | 5/1951 | Wallach . |
| 3,514,856 | 6/1970 | Camp . |
| 3,543,402 | 12/1970 | Seager . |
| 3,607,485 | 9/1971 | Bailey . |
| 3,703,766 | 11/1972 | Tibbals . |
| 3,761,373 | 9/1973 | Sastri . |
| 3,834,265 | 9/1974 | Tafapolsky . |
| 3,911,579 | 10/1975 | Lane . |
| 4,534,827 | 8/1985 | Henderson . |
| 4,702,004 | 10/1987 | Haythornthwaite . |

FOREIGN PATENT DOCUMENTS

| | | |
|---|---|---|
| 6058805 | 4/1985 | Japan . |
| 6058806 | 4/1985 | Japan . |
| 1423831 | 2/1976 | United Kingdom . |

*Primary Examiner*—Douglas D. Watts

*Attorney, Agent, or Firm*—Fish & Richardson .

[57] ABSTRACT

A process for forming a razor blade includes the steps of providing a ceramic substrate, mechanically abrading an edge of the ceramic substrate to form a sharpened edge thereon with facets that have an included angle of less than thirty degrees; thermally processing the mechanically abraded edge to reduce surface raggedness and subsurface defects; and sputter-sharpening the sharpened edge to provide supplemental facets that have an included angle of more than forty degrees and define a tip radius of less than five hundred angstroms. The resulting blade exhibit excellent shaving properties.

31 Claims, 1 Drawing Sheet

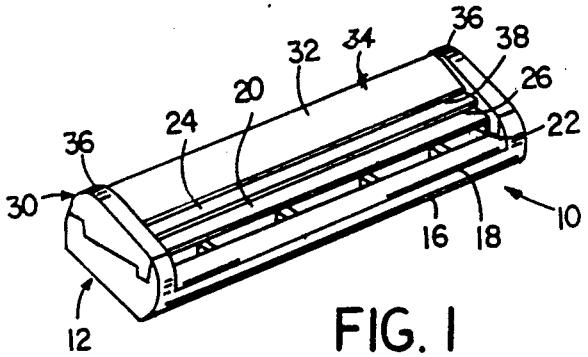
FIG. 1
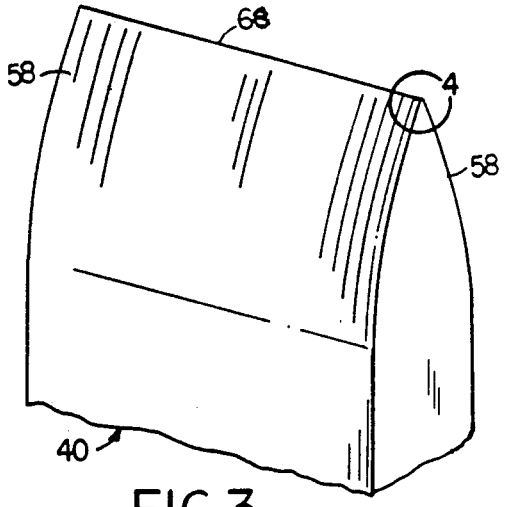
FIG.3
FIG.2
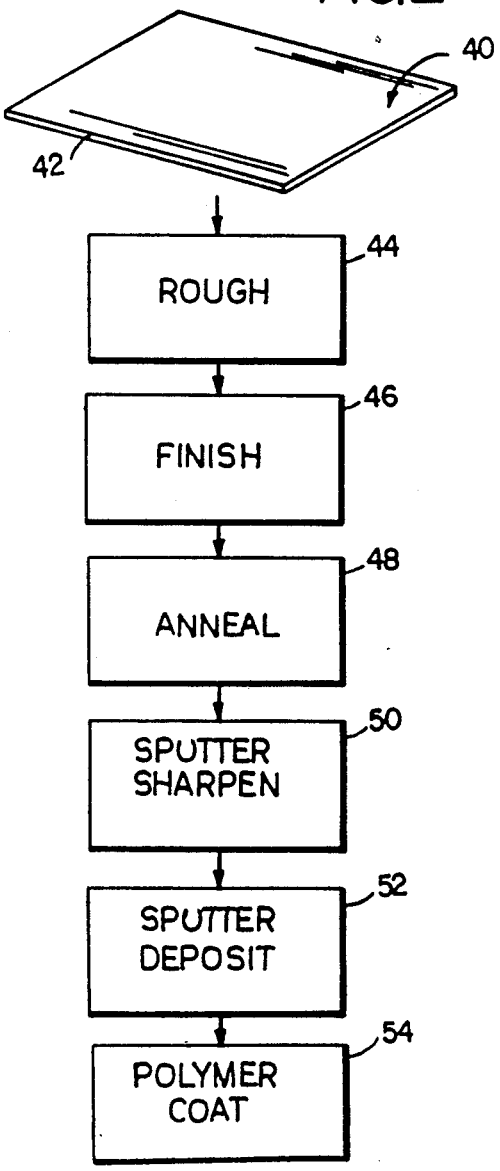
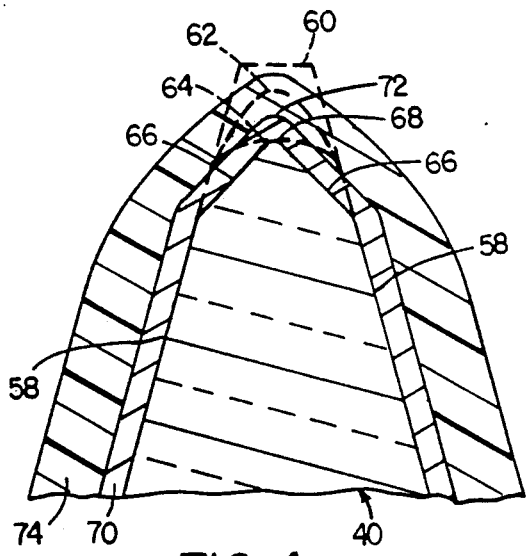
FIG.4

RAZOR BLADE TECHNOLOGY

This is a continuation of U.S. Pat. No. 535,741, filed June 8, 1990, now abandoned.

This invention relates to processes for producing and treating ceramic razor blades or similar cutting tools with sharp and durable cutting edge and to improved razors and razor blades.

While razor blades are conventionally produced from steel strips in which a sharpened edge is formed through a series of mechanical grinding and honing operations, ceramic materials have also been proposed for razor blades because of their desirable properties of high hardness, mechanical strength and corrosion resistance. While steel can exhibit increased strength in the worked area (e.g. the sharpened edge) from the mechanical cold working (e.g. finish-honing operations), ceramic materials in similar mechanical sharpening operations often exhibit weaker strength in the worked area because of microscale, subsurface defects induced by the considerable stress that accompany mechanical grinding and finish honing and tend to be more susceptible than steel razor blade edges to fracture-type breakdown of the cutting edges during shaving.

In accordance with one aspect of the invention, there is provided a process for forming a razor blade that includes the steps of providing a ceramic substrate, mechanically abrading an edge of the ceramic substrate to form a sharpened edge thereon that has an included angle of less than thirty degrees and a tip radius (i.e. the estimated radius of the largest circle that may be positioned within the ultimate tip of the edge when such ultimate tip is viewed under a scanning electron microscope at magnifications of at least 25,000) of less than twelve hundred angstroms; and sputter-sharpening the sharpened edge to form supplemental facets that have widths of less than one micrometer, have an included angle greater than forty degrees, define an ultimate tip radius of less than five hundred angstroms and form a cutting edge. The resulting blades exhibit excellent shaving properties and long shaving life.

In preferred processes, the ceramic substrate is abraded in two-step sequence of rough-honing and finish-honing with diamond abrasive material that minimizes mechanically-induced subsurface defects, (instead of a more conventional three-step steel sharpening sequence that includes a grinding step) to form a sharpened edge. The mechanically abraded edge of the ceramic substrate then is subjected to heat-treatment at a temperature of at least 1000° C., herein referred to as "annealing", that reduces surface raggedness and subsurface defects resulting from the mechanical abrasion sequence and to produce a micro-scale plateau-like top of less than about 0.2 micrometers width at the ultimate tip. The annealing may be performed in air or in other gaseous environments and the duration of annealing may decrease with higher annealing temperatures, for example, with an oxygen-hydrogen annealing flame. The plateau-like top of the blade edge then is sputter-sharpened by ion-beam etching to form supplemental facets of width in the range of 0.1–0.5 micrometers; to further reduce subsurface defect areas, and at the same time to reduce the ultimate tip radius of the sharpened edge by a factor of at least about two, as well as to provide a clean edge surface on which a metal layer that preferably contains chromium is sputter-deposited. An adherent and friction-reducing polymer coating is then applied on the metal-coated cutting edge.

In a particular process, the ceramic material is single crystal alumina (sapphire) with a thickness of less than 0.5 millimeter, and a bend strength in excess of 700 MPa; the rough-honing operation employs grinding wheels with diamond particles with grain sizes of less than twenty micrometers and the finish-honing operation employs sharpening wheels with an average diamond particle size of about one micrometer; annealing of the mechanically sharpened edge is carried out in air at a temperature of about 1550° C. for about one hour; the sputter-sharpened facets of the ultimate edge have widths in the range of 0.2–0.5 micrometer and an effective included angle of about seventy degrees; the sputter-coated metallic layer has a thickness of less than five hundred angstroms, and the polymer layer has a thickness of less than ten micrometers.

In accordance with another aspect of the invention, there is provided a razor blade that includes a ceramic substrate with mechanically abraded and thermally annealed facets generally parallel (that is, within at least thirty degrees and preferably within ten degrees) to its C crystallographic axis and supplemental sputter-sharpened facets that have an effective included angle substantially greater than the included angle of the mechanically abraded sharpened facets, and that define a sputter-sharpened cutting edge with an ultimate tip radius of less than five hundred angstroms.

In particular embodiments, the razor blade substrate is single crystal alumina (sapphire), and has a bend strength in excess of 700 MPa; the mechanically abraded facets have an effective included angle of less than twenty degrees; the sputter-sharpened facets of the ultimate edge have widths of about 0.3 micrometer, an effective included angle greater than forty degrees, and substantial uniformity in ultimate tip radius along the length of the entire cutting edge. A sputter-deposited metallic layer on the cutting edge is less than five hundred angstroms thickness, and an adherent, friction-reducing polymer coating on the metal-coated ceramic cutting edge is less than ten micrometers in thickness. Preferably, the ceramic substrate is single crystal material selected from silicon carbide, silicon nitride, zirconia and alumina, particularly preferred substrate materials being high-purity alumina and hot-isostatically-pressed tetragonal zirconia. The heat-treatment reduces surface raggedness and subsurface defects resulting from the mechanical abrasion sequence and the sputter-sharpening further reduces such subsurface defect areas, and reduces the ultimate tip radius of the sharpened edge.

The resulting large facet angle (immediately adjacent the tip), low tip radius annealed blades with sputter-deposited metallic layer and adherent, friction-reducing polymer coating exhibit strength and excellent shaving characteristics.

In accordance with another aspect of the invention, there is provided a shaving unit that comprises at least one blade and blade support structure that has external guard and cap surfaces for engaging the user's skin respectively ahead and rearwardly of the blade edge or edges. Razor blade structure secured to the support structure includes a ceramic substrate with mechanically abraded facets that have a width of at least about 0.1 millimeter and an included angle of less than thirty degrees, and a sputter-sharpened cutting edge of tip radius less than about five hundred angstroms that is defined by facets that have an effective included angle substantially greater than the included angle of the mechanically abraded facets, the sputter-sharpened cutting edge being disposed between the skin-engaging surfaces. Preferably, the razor blade structure includes two ceramic substrates, and each ceramic substrate is thermally annealed and has a sputter-sharpened cutting edge of tip radius less than about five hundred angstroms that is defined by facets that have an effective included angle of at least forty degrees, and the sputter-sharpened cutting edges being disposed parallel to one another between the skin-engaging surfaces.

In a particular embodiment, the ceramic substrate material is alumina and has a bend strength in excess of 300 MPa, each sputter-sharpened facet immediately adjacent the cutting edge has a width of about 0.3 micrometer and an effective included angle of about seventy degrees, a sputter-deposited metal layer is on the cutting edge, and an adherent polymer coating is on the metal coated cutting edge, the sputter-deposited metal layer has a thickness of less than five hundred angstroms, and the adherent polymer coating on the metal layer has a thickness of less than ten micrometers.

The shaving unit may be of the disposable cartridge type adapted for coupling to and uncoupling from a razor handle or may be integral with a handle so that the complete razor is discarded as a unit when the blade or blades becomes dulled. The front and rear skin engaging surfaces cooperate with the blade edge (or edges) to define the shaving geometry. Particularly preferred shaving units are of the types shown in U.S. Pat. No. 3,876,563 and in U.S. Pat. No. 4,551,916.

Other features and advantages will be seen as the following description of particular embodiments progresses, in conjunction with the drawings, in which:

FIG. 1 is a perspective view of a shaving unit in accordance with the invention;

FIG. 2 is a flow diagram indicating a sequence of steps in manufacturing a razor blade in accordance with the invention;

FIG. 3 is a perspective view of a portion of a razor blade in accordance with the invention; and FIG. 4 is an enlarged diagrammatic view (as viewed in a scanning electron microscope originally at about 50,000 magnification) of the ultimate tip of the razor blade shown in FIG. 3.

DESCRIPTION OF PARTICULAR EMBODIMENTS

The shaving unit 10 shown in FIG. 1 includes a base or platform member 12 molded of high impact polystyrene for attachment to a razor handle and guard structure 16 that defines a transversely extending forward skin engaging surface 18. On the upper surface of platform 12 are disposed ceramic leading blade 20 having a sharpened edge 22, ceramic following blade 24 having sharpened edge 26, and spacer structure that maintains blades 20 and 24 in spaced relation. Cap member 30 is molded of high impact polystyrene and has body portion 32 that defines skin engaging surface 34 that extends transversely between forwardly projecting end walls 36 and has a front edge 38 that is disposed rearwardly of blade edge 26.

Blades 20 and 24 are manufactured in accordance with the sequence shown in FIG. 2. Each blade 20, 24 is formed from a ceramic razor blade blank 40 of single crystal aluminum oxide (sapphire) that has a width of about 0.6 centimeter, a length of about 3.8 centimeters, a thickness of about 0.1 millimeter, and edge surface 42 parallel to its C crystallographic axis that is to be sharpened to a cutting edge.

With reference to FIG. 2, blank 40 is subjected to a sequence of edge forming operations including rough-honing operation 44; finish-honing operation 46; annealing operation 48; and sputter-sharpening operation 50 to form a blade edge of cross sectional configuration as diagrammatically indicated in the perspective view of FIG. the blade is then subjected to sputter-depositing operation 52. The blade has rough-honed facets 58 of about 0.5 millimeter width and an included angle of about nine degrees and a flat top diagrammatically indicated at 60 (FIG. 4) that is modified by finish-honing 46 to form a tip 62 of about 700 angstroms tip radius (FIG. 4). After reduction of surface raggedness and of subsurface defects by annealing 48 and sputter-sharpening 50, the resulting ultimate tip 68 defined by facets 66 has an included angle of about seventy degrees and a tip radius of about 300 angstroms.

In the rough-honing operation 44, the blade blank 40 is fed, at a transfer speed of about 360 centimeters per minute, past an abrasive wheel (with diamond particles of 8–16 micrometers grain size) with an oil flow of 1.8 liters per minute and the wheel rotating into the blade edge at 1100 RPM, a set angle of 4.5 degrees (the angle between the plane of the blade 40 and a tangent to the wheel where the blade makes contact with the wheel), a sharpening infeed of about 0.5 millimeter (the blade deflection by the sharpening wheel), and a spring force of about one kilogram, to form rough-hone facets 58 that have an included angle of about nine degrees and a width of about 0.5 millimeter and relatively flat top 60 that has a width of about ten micrometers.

The rough-honed facets 58 are then subjected to a finish-honing operation at stage 46 in which the blade edge is abraded to form tip 62 of about 600–800 angstroms radius. The sharpening wheels at the finish-hone stage 46 have diamond particles with an average grain size of one micron and are rotated at a speed of 1130 RPM away from the blade 40 with a set angle of about 8 degrees, a sharpening infeed of 0.2 millimeter and a spring force of about one kilogram, and the blade 40 is fed at a transfer speed of about 170 centimeters per minute.

After the mechanically sharpened blades 40 have been degreased in methylene chloride and solvent-washed ultrasonically in Freon, the degreased and particulate-free blades are placed in a tube furnace and annealed at 1550° C. for one hour in air. Such annealing treatment of the mechanically sharpened, ceramic edge produces significant change in the tip region such that the annealed ultimate tip now has a micro-scale, plateau-like top region diagrammatically indicated at 64 along the length of the blade edge that is about 1000 angstroms in width. Edge surface raggedness is reduced, and subsurface defects that were created during the mechanical honing operations (as evidenced by transmission electron microscopy analysis) are also reduced.

The annealed blades 40 are then placed in a sputtering chamber with an elongated cathode, the blade edges being normal to the cathode at a blade edge-to-cathode distance of about seven centimeters. The sputtering chamber is evacuated to a pressure of equal to or better than $2\times10^{-6}$ torr, and argon is introduced to attain a sputtering gas pressure of ten millitorr. 13.56 megahertz RF power is applied to establish a stable plasma with 200 watts RF forward power and a sputter-sharpening duration of about 135 seconds to produce sputter-sharpened facets 66 that have widths of about 0.3 micrometers and an included angle of about seventy degrees and an ultimate tip 68 radius of about 300 angstroms as diagrammatically indicated in FIG. 4. Edge surface raggedness and subsurface defects that were created during the mechanical honing operations (as evidenced by transmission electron microscopy analysis) are further reduced.

Following the sputter-sharpening procedure 50, the sputter unit is switched from sputter-sharpening (ion-beam etching) mode to deposition mode using a matching network selector; a plasma is ignited at 400 watts and ten millitorr pressure, and a chromium-platinum target is presputtered for about five minutes with a substrate shielded between the blades and the target. Upon completion of presputtering, the substrate shield is retracted and sputtered atoms of chromium and platinum are deposited on the sharpened blade edges to form a stabilizing metallic layer 70 of about three hundred angstroms thickness and a tip radius of about 350 angstroms as diagrammatically indicted in FIG. 4.

A coating 72 of polytetrafluoroethylene telomer is then applied to the sputter-coated edges of the blades in accordance with the teaching of U.S. Pat. No. 3,518,110. This process involves heating the blades in an argon environment and providing on the cutting edges of the blades an adherent and friction-reduction polymer coating 74 of solid PTFE as diagrammatically indicted in FIG. 4.

A diagrammatic view of the resulting blade edge is shown in FIG. 4. The radius of the modified (sputter-sharpened) tip 68 is about three hundred angstroms, the included angle of the sputter-sharpened surfaces 66 forming the modified tip 68 is about seventy degrees and the included angle of the mechanically abraded and annealed facets 58 is about nine degrees. Resulting ceramic blades 20, 24 are assembled in razor 10. The razor exhibits excellent shaving properties and shaving life.

While particular embodiments of the invention have been shown and described, various modifications will be apparent to those skilled in the art, and therefore, it is not intended that invention be limited to the disclosed embodiment, or to details thereof, and departures may be made therefrom within the spirit and scope of the invention.

What is claimed is:

1. A process for forming a razor blade comprising the steps of providing a ceramic substrate, mechanically abrading said ceramic substrate in a sequence of rough-honing and finish-honing steps with diamond abrasive materials to form a sharpened edge thereon with facets that have an included angle of less than thirty degrees and a tip radius of less than twelve hundred angstroms; and sputter-sharpened said edge to form a cutting edge defined by supplemental facets that are less than one micrometer in width and have an included angle greater than forty degrees.

2. The process of claim 1 wherein said ceramic substrate material is selected from the group consisting of silicon carbide, silicon nitride, zirconia, and alumina.

3. The process of claim 1 wherein said ceramic substrate has a bend strength in excess of 300 MPa.

4. The process of claim 3 wherein said ceramic substrate is of single crystal material and has a bend strength in excess of 700 MPa.

5. The process of claim 5 wherein said rough-honing step forms facets that have an included angle of less than twenty degrees.

6. The process of claim 1 wherein said step of mechanically abrading said ceramic substrate forms a sharpened edge thereon that has an ultimate tip radius in the range of 600 to 800 angstroms.

7. A process for forming a razor blade comprising the steps of providing a ceramic substrate, mechanically abrading said ceramic substrate to form a sharpened edge thereon with facets that have an included angle of less than thirty degrees and a tip radius of less than twelve hundred angstroms;

sputter-sharpening said edge to form a cutting edge defined by supplemental facets that are less than one micrometer in width and have an included angle greater than forty degrees;

sputter depositing a chromium-containing metal layer on said cutting edge; and then applying an adherent polymer coating on said metal coated cutting edge.

8. The process of claim 7 wherein said sputter-deposited metal layer on said cutting edge has a thickness of less than five hundred angstroms, and said adherent polymer coating on said metal coated cutting edge has a thickness of less than ten micrometers.

9. A process for forming a razor blade comprising the steps of providing a ceramic substrate, mechanically abrading said ceramic substrate to form a sharpened edge thereon with facets that have an included angle of less than thirty degrees and a tip radius of less than twelve hundred angstroms; and sputter-sharpening said edge to form a cutting edge defined by supplemental facets that are less than one micrometer in width and have an included angle greater than forty degrees, the sputter-sharpened surfaces immediately adjacent said cutting edge having widths in the range of 0.1–0.5 micrometer, an effective included angle substantially greater than the included angle of said mechanically-abraded facets, and providing a tip radius of less than five hundred angstroms.

10. The process of claim 9 wherein said ceramic substrate material is selected from the group consisting of alumina and zirconia.

11. The process of claim 1 and further including the step of annealing said mechanically-abraded ceramic substrate to modify the ultimate tip region and reduce subsurface defects and surface irregularities adjacent said sharpened edge.

12. The process of claim 11 wherein said ceramic substrate material is selected from the group consisting of silicon carbide, silicon nitride, zirconia, and alumina.

13. The process of claim 11 wherein said ceramic substrate is of single crystal material and has a bend strength in excess of 700 MPa.

14. A process for forming a razor blade comprising the steps of providing a ceramic substrate, mechanically abrading said ceramic substrate to form a sharpened edge thereon with facets that have an included angle of less than thirty degrees and a tip radius of less than twelve hundred angstroms; said step of mechanically abrading said ceramic substrate including a rough-honing step that form facets that have an included angle of less than twenty degrees and a finish-honing step that forms a sharpened edge that has an ultimate tip radius in the range of 600 to 800 angstroms, annealing said mechanically-abraded ceramic substrate to modify the ultimate tip region and reduce subsurface defects and surface irregularities adjacent said sharpened edge; and sputter-sharpening said edge to form a cutting edge defined by supplemental facets that are less than one micrometer in width and have an included angle greater than forty degrees.

15. The process of claim 11 wherein said ceramic substrate material is single crystal material selected from the group consisting of alumina and zirconia that has a bend strength in excess of 700 MPa, said ceramic substrate is mechanically abraded in a sequence of rough-honing and finish-honing steps with diamond abrasive material with grain size of less than twenty micrometers and further including the steps of sputter depositing a metallic layer on said cutting edge to a thickness of less than five hundred angstroms, and then applying an adherent polymer coating on said metal coated cutting edge to a thickness of less than ten micrometers.

16. The process of claim 11 wherein said annealing is at a temperature of at least 1000° C.

17. A razor blade comprising a ceramic substrate with mechanically-abraded facets that have a width of at least about 0.1 millimeter and an included angle of less than thirty degrees, a sputter-sharpened cutting edge of tip radius less than about five hundred angstroms that is defined by supplemental sputter-sharpened facets that have an effective included angle substantially greater than the included angle of said mechanically abraded facets, a sputter-deposited metal layer on said sputter-etched cutting edge, and an adherent polymer coating on said metal coated cutting edge.

18. The razor blade of claim 17 wherein said mechanically-abraded facets are thermally annealed.

19. The razor blade of claim 17 wherein said sputter-sharpened surfaces immediately adjacent said cutting edge have widths in the range of 0.1–0.5 micrometer.

20. The razor blade of claim 17 wherein said sputter-deposited metal layer on said sputter-sharpened cutting edge has a thickness of less than five hundred angstroms, and said adherent polymer coating on said metal coated cutting edge has a thickness of less than ten micrometers.

21. A razor blade comprising a ceramic substrate with mechanically-abraded facets that have a width of at least about 0.1 millimeter and an included angle of less than thirty degrees, and a sputter-sharpened cutting edge of tip radius less than about five hundred angstroms that is defined by supplemental sputter-sharpened facets that have an effective included angle substantially greater than the included angle of said mechanically abraded facets, said cutting edge being generally parallel to the C crystallographic axis of said substrate.

22. The razor blade of claim 21 wherein said ceramic substrate material is selected from the group consisting of silicon carbide, silicon nitride, zirconia, and alumina and has a bend strength in excess of 300 MPa.

23. The razor blade of claim 22 wherein each said sputter-sharpened facet immediately adjacent said cutting edge has a width of about 0.3 micrometer and an effective included angle of at least forty degrees, and further including a sputter-deposited metal layer on said cutting edge, and an adherent polymer coating on said metal coated cutting edge, said sputter-deposited metal layer having a thickness of less than five hundred angstroms, and said adherent polymer coating on said metal layer having a thickness of less than ten micrometers.

24. The razor blade of claim 21 wherein said mechanically abraded facets are thermally annealed at a temperature of at least 1000° C.

25. A shaving unit comprising support structure that defines spaced skin-engaging surfaces, and razor blade structure secured to said support structure, said razor blade structure including a ceramic substrate with mechanically-abraded facets that have a width of at least about 0.1 millimeter and an included angle of less than thirty degrees, and a sputter-sharpened cutting edge of tip radius less than about five hundred angstroms that is defined by facets that have an effective included angle substantially greater than the included angle of said mechanically-abraded facets, a sputter-deposited metal layer on said sputter-etched cutting edge, and an adherent polymer coating on said metal coated cutting edge, said sputter-sharpened cutting edge being disposed between said skin-engaging surfaces.

26. The shaving unit of claim 25 wherein said razor blade structure includes two ceramic substrates, and each said ceramic substrate has a sputter-sharpened cutting edge of tip radius less than about five hundred angstroms that is defined by facets that have an effective included angle substantially greater than the included angle of said mechanically-abraded facets, said sputter-sharpened cutting edges being disposed parallel to one another between said skin engaging surfaces.

27. The shaving unit of claim 25 wherein said sputter-sharpened surfaces immediately adjacent said cutting edge have widths in the range of 0.1–0.5 micrometer.

28. The razor blade of claim 25 wherein said mechanically-abraded facets are thermally annealed.

29. The shaving unit of claim 28 wherein said razor blade structure includes two ceramic substrates, and each said ceramic substrate has a sputter-sharpened cutting edge of tip radius less than about five hundred angstroms that is defined by facets that have an effective included angle substantially greater than the included angle of said mechanically abraded facets, said sputter-sharpened cutting edges being disposed parallel to one another between said skin-engaging surfaces.

30. The shaving unit of claim 29 wherein said ceramic substrate material is selected from the group consisting of silicon carbide, silicon nitride, zirconia, and alumina and has a bend strength in excess of 700 MPa.

31. A shaving unit comprising support structure that defines spaced skin-engaging surfaces, and razor blade structure secured to said support structure, said razor blade structure including two ceramic substrates of material selected from the group consisting of silicon carbide, silicon nitride, zirconia, and alumina and having a bend strength in excess of 700 MPa, each said substrate having thermally annealed mechanically-abraded facets that have a width of at least about 0.1 millimeter and an included angle of less than thirty degrees, and a sputter-sharpened cutting edge of tip radius less than about five hundred angstroms that is defined by facets that have an effective included angle substantially greater than the included angle of said mechanically-abraded facets, each said sputter-sharpened facet immediately adjacent said cutting edge having a width of about 0.3 micrometer and said sputter-sharpened facets having an effective included angle of at least forty degrees, a sputter-deposited metal layer of thickness less than five hundred angstroms on each said cutting edge, and an adherent polymer coating of thickness of less than ten micrometers on each said metal layer, said sputter-sharpened cutting edge being disposed between said skin-engaging surfaces.

* * * * *